US008454404B2

(12) United States Patent
Iijima et al.

(10) Patent No.: US 8,454,404 B2
(45) Date of Patent: Jun. 4, 2013

(54) METHOD AND APPARATUS FOR MANUFACTURING SEALED PANEL AND METHOD AND APPARATUS FOR MANUFACTURING PLASMA DISPLAY PANEL

(75) Inventors: Eiichi Iijima, Chigasaki (JP); Muneto Hakomori, Chigasaki (JP); Toshiharu Kurauchi, Tsukuba (JP); Takanobu Yano, Tsukuba (JP); Yuichi Orii, Chigasaki (JP)

(73) Assignee: Ulvac, Inc., Chigasaki-Shi (JP)

( * ) Notice: Subject to any disclaimer, the term of this patent is extended or adjusted under 35 U.S.C. 154(b) by 246 days.

(21) Appl. No.: 12/601,097

(22) PCT Filed: May 30, 2008

(86) PCT No.: PCT/JP2008/060019

§ 371 (c)(1),
(2), (4) Date: Nov. 20, 2009

(87) PCT Pub. No.: WO2008/149804

PCT Pub. Date: Dec. 11, 2008

(65) Prior Publication Data

US 2010/0159787 A1 Jun. 24, 2010

(30) Foreign Application Priority Data

Jun. 8, 2007 (JP) ..... P2007-153291

(51) Int. Cl.
*H01J 9/26* (2006.01)
*H01J 9/24* (2006.01)

(52) U.S. Cl.
USPC ..... 445/25; 445/24

(58) Field of Classification Search
None
See application file for complete search history.

(56) References Cited

U.S. PATENT DOCUMENTS

| | | | | |
|---|---|---|---|---|
| 4,273,585 | A * | 6/1981 | Krohn et al. | 501/15 |
| 4,377,404 | A * | 3/1983 | Hoshikawa et al. | 65/59.22 |
| 6,796,868 | B2 * | 9/2004 | Konishi et al. | 445/25 |
| 7,070,471 | B2 * | 7/2006 | Shiokawa et al. | 445/24 |
| 7,152,433 | B2 * | 12/2006 | Nakata | 65/32.2 |
| 7,888,870 | B2 * | 2/2011 | Hasegawa et al. | 501/73 |
| 2004/0053555 | A1 * | 3/2004 | Sasaki et al. | 445/25 |

(Continued)

FOREIGN PATENT DOCUMENTS

| | | |
|---|---|---|
| JP | 2002-75192 | 3/2002 |
| JP | 2002-367514 | 12/2002 |

(Continued)

OTHER PUBLICATIONS

Machine translation of Applicant cited JP2002-075192 A.*

(Continued)

*Primary Examiner* — Anh T. Mai
*Assistant Examiner* — Britt D Hanley
(74) *Attorney, Agent, or Firm* — Grossman, Tucker, Perreault & Pfleger, PLLC

(57) ABSTRACT

A method for manufacturing a sealed panel having a first substrate and a second substrate, including: a melting step of melting a sealing material which does not contain a binder for making the sealing material into paste form; a coating step of applying the melted sealing material onto a surface of the second substrate; and a sealing step of laminating the first substrate and the second substrate via the sealing material applied onto the surface of the second substrate.

4 Claims, 9 Drawing Sheets

U.S. PATENT DOCUMENTS

| | | | | |
|---|---|---|---|---|
| 2004/0071925 | A1* | 4/2004 | Kato et al. | 428/69 |
| 2004/0119397 | A1* | 6/2004 | Sakamoto | 313/495 |
| 2004/0160184 | A1* | 8/2004 | Sun et al. | 313/582 |
| 2004/0207314 | A1* | 10/2004 | Aitken et al. | 313/504 |

FOREIGN PATENT DOCUMENTS

| | | |
|---|---|---|
| JP | 2003-223847 | 8/2003 |
| RU | 2185678 | 7/2002 |
| RU | 2 248 062 | 3/2005 |
| RU | 2285974 | 10/2006 |
| SU | 497653 | 12/1975 |
| WO | 02/13223 | 2/2002 |

OTHER PUBLICATIONS

International Search Report from corresponding PCT Application No. PCT/JP2008/060019.

Tatsuo Uchida et al., "Encylopedia of Flat Panel Displays", Dec. 2001, with partial English translation.

Office Action from corresponding Russian Application No. 2009144978 dated Mar. 10, 2011. English translation attached.

Decision of Grant from corresponding Russian Application No. 2009144978/07 dated Jun. 8, 2011. English translation attached.

Office Action from corresponding Japanese Application No. 2009-517841 dated Oct. 2, 2012. English translation attached.

* cited by examiner

METHOD AND APPARATUS FOR MANUFACTURING SEALED PANEL AND METHOD AND APPARATUS FOR MANUFACTURING PLASMA DISPLAY PANEL

TECHNICAL FIELD

The present invention relates to method and apparatus for manufacturing a sealed panel, and method and apparatus for manufacturing a plasma display panel.

Priority is claimed on Japanese Patent Application No. 2007-153291, filed Jun. 8, 2007, the contents of which are incorporated herein by reference.

BACKGROUND ART OF THE INVENTION

Conventionally, plasma display panels (referred to below as "PDP") are widely used in the field of display devices, and recently there have been demands for large-screen PDPs which have excellent quality but are low in cost.

PDPs are formed by laminating a front substrate and a rear substrate via a sealing material, and an electrical discharge gas is sealed thereinside. Three-electrode surface discharge technology is commonly used for PDPs in which sustaining electrodes and scanning electrodes are formed on the front substrate, and address electrodes are formed on the rear substrate. When voltage is applied between the scanning electrodes and the address electrodes so as to generate an electrical discharge, the sealed electrical discharge gas converted into plasma and ultraviolet rays are discharged. Phosphors which are formed on the rear substrate are excited by the ultraviolet rays resulting in visible light being discharged.

A process for manufacturing a PDP includes a coating step of applying the sealing material onto a peripheral edge portion of the rear substrate, and a sealing step of laminating and sealing the front substrate and the rear substrate. In the sealing material coating step, the sealing agent transformed into paste is applied onto the rear substrate. Therefore, a sealing material is employed in which is mixed a binder which is made of solvent and resin component. Moreover, after the sealing material has been applied, a drying step is performed (for example, at a temperature of 120° C. for 10 to 20 minutes) in order to remove the solvent, and a temporary baking step (for example, see Non-patent document 1) is also performed in order to remove the resin component. In the temporary baking step, a rear substrate which has completed the drying step is firstly heated in air or in an oxygen atmosphere from a temperature of 120° C. to 320° C. over a temperature increase time of 5° C. to 10° C. per minute. Next, the rear substrate is heated from a temperature of 320° C. to 380° C. at a temperature increase rate of 4° C. per minute. The rear substrate is then held at a temperature of 380° C. for 10 minutes. Thereafter, the rear substrate is cooled to room temperature at a temperature decrease rate of 5° C. to 50° C. per minute. It is noted that the heating is performed at a gentle pace is in order to ensure the dissolution and combustion of the binder.

[Non-patent document 1] "Encyclopedia of Flat Panel Displays", Tatsuo Uchida et. al., December 2001, pp 752-754, 868-869

DISCLOSURE OF THE INVENTION

Problems to be Solved by the Invention

However, it is difficult to completely remove the resin component from the binder which is contained in the sealing material simply by performing the above described temporary baking. Resin component which remains in the sealing material changes into an impurity gas when the two substrates are being sealed together and contaminates the panel interior. Contamination caused by the resin component is one factor making it necessary to purify (i.e., dry) the interior of the panel by heating and evacuating (i.e., vacuum baking) for several hours during the sealing step. That is also a factor making it necessary to apply AC voltage to the sealed panel for discharging, and to perform aging (i.e., pre-conditioning) for several hours to several tens of hour in order to reduce the discharge voltage of the panel and stabilize the discharge characteristics of the panel (see, for example, Non-patent document 1). Accordingly, preventing any resin component from remaining in the binder in the sealing material is a huge problem for achieving an improvement in throughput in the PDP manufacturing process and an improvement in energy efficiency.

The present invention was conceived in order to solve the above described problem, and it is an object thereof to provide method and apparatus for manufacturing a sealed panel, and also method and apparatus for manufacturing a sealed panel which make it possible to achieve an improvement in throughput and energy efficiency.

Means for Solving the Problem

In order to achieve the above described object, the present invention employs the following. In particular, a method for manufacturing a sealed panel having a first substrate and a second substrate according to the present invention includes: a melting step of melting a sealing material which does not contain a binder for making the sealing material into paste form; a coating step of applying the melted sealing material onto a surface of the second substrate; and a sealing step of laminating the first substrate and the second substrate via the sealing material applied onto the surface of the second substrate.

According to the above described method for manufacturing a sealed panel, by melting a sealing material which does not contain a binder, it is possible to apply the sealing material onto the surface of the second substrate. Moreover, since a sealing material which does not contain a binder is used, it is possible to greatly reduce the quantity of gas released from the sealing material. As a result, it is possible to considerably reduce the amount of time required to purify (i.e., dry) the panel interior in the sealing step, or else to eliminate the purification (i.e., drying) altogether. Further, it is also possible to considerably reduce the amount of time required for aging (i.e., pre-conditioning) after the sealing step, or else to eliminate the aging step altogether. Moreover, a binder removal step such as that required in the conventional technology is not necessary. Accordingly, it is possible to achieve an improvement in throughput and energy efficiency in manufacturing plasma display panels.

It may be arranged such that the sealing material contains a low melting point glass.

In this case, it is possible to reduce the quantity of gas released from the sealing material. Moreover, the coating and sealing can be performed at a comparatively low temperature. Further, air-tightness and cohesion strength after the sealing can be secured.

It may be arranged such that the sealing material contains a low melting point glass and a filler.

In this case, since the coefficient of thermal expansion of the sealing material becomes close to the coefficients of thermal expansion of the first substrate and second substrate, the air-tightness and cohesion strength after the sealing can be secured.

It may be arranged such that the method further includes a step of emitting gas contained within the melted sealing material.

In this case, since the gas existing inside the applied sealing material has been expelled therefrom, it is possible to further reduce the quantity of gas released from the sealing material.

Meanwhile, a method for manufacturing a plasma display panel having a first substrate and a second substrate according to the present invention includes: a melting step of melting a sealing material which does not contain a binder for making the sealing material into paste form; a baking step of baking phosphors applied onto the second substrate; a coating step of applying the melted sealing material onto a surface of the second substrate; and a sealing step of laminating the first substrate and the second substrate via the sealing material applied onto the surface of the second substrate, wherein the temperature of the second substrate is held at 100° C. or more from the baking step through the coating step.

According to the above described method for manufacturing a plasma display panel, since a sealing material which does not contain a binder is used, the melted sealing material can be applied onto the surface of the second substrate. In this case as well, it is possible to utilize in the coating step the heat energy applied to the second substrate in the baking step. As a result, it is possible to achieve a reduction of energy consumption.

It may be arranged such that the second substrate is held in a vacuum or a controlled atmosphere from the baking step through the sealing step.

In this case, since a sealing material which does not contain a binder is used, it is not necessary to perform the drying step and baking step in the atmosphere for removing the binder. Because of this, it is possible to introduce the second substrate to the sealing step after the phosphors have been baked while maintaining it in a vacuum or in a controlled atmosphere, and thus preventing any impurity gas from adsorbing to the second substrate. As a result, it is possible to considerably reduce the amount of time required to purify (i.e., dry) the panel interior in the sealing step, or else to eliminate this purification (i.e., drying) altogether. Further, it is also possible to considerably reduce the amount of time required for aging (i.e., pre-conditioning) after the sealing step, or else to eliminate the aging step altogether. Accordingly, it is possible to achieve an improvement in throughput and energy efficiency in manufacturing plasma display panels.

Moreover, another method for manufacturing a plasma display panel having a first substrate and a second substrate according to the present invention includes: a film formation step of forming a protective film on the first substrate at a size corresponding to the first substrate; a melting step of melting a sealing material which does not contain a binder for making the sealing material into paste form; a baking step of baking phosphors applied onto the second substrate are baked; a coating step of applying the melted sealing material onto a surface of the second substrate; and a sealing step of laminating a plurality of pairs of the first substrate and the second substrate in parallel via the sealing material applied onto the surface of each of the second substrates, wherein the temperature of the second substrates is held at 100° C. or more from the baking step through the coating step.

According to the above described method for manufacturing a plasma display panel, since the processing time of the film formation step is generally shorter than the processing time of the sealing step, it is possible to achieve an improvement in throughput in manufacturing plasma display panels.

It may be arranged such that in the sealing step, when a plurality of plasma display panels having mutually different sizes are being manufactured, first substrates and second substrates which correspond to the sizes of the respective plasma display panels are laminated to each other.

In this case, it is possible to efficiently manufacture panels of different sizes.

Meanwhile, an apparatus for manufacturing a sealed panel having a first substrate and a second substrate according to the present invention includes: a coating chamber in which a sealing material which does not contain a binder for making the sealing material into paste form is applied onto a surface of the second substrate in a vacuum or in a controlled atmosphere; a coating device which is provided in the coating chamber and applies the sealing material filled inside the coating device onto the surface of the second substrate; a heater which is provided in the coating device and melts the filled sealing material; and a sealing chamber in which the first substrate and the second substrate are laminated to each other via the sealing material.

According to the above described method for manufacturing a sealed panel, even if a sealing material which does not contain a binder is used, it is possible to melt the sealing material inside the coating device and then apply it onto the surface of the second substrate. Moreover, by using a sealing material which does not contain a binder, it is possible to considerably reduce the quantity of gas released from the sealing material. As a result, it is possible to considerably reduce the amount of time required to purify (i.e., dry) the panel interior in the sealing step, or else to eliminate this purification (i.e., drying) altogether. Further, it is also possible to considerably reduce the amount of time required for aging (i.e., pre-conditioning) after the sealing step, or else to eliminate this aging step altogether. Moreover, a binder removal step such as that required in the conventional technology is not necessary. Accordingly, it is possible to achieve an improvement in throughput and energy efficiency in manufacturing plasma display panels.

An apparatus for manufacturing a plasma display panel having a first substrate and a second substrate according to the present invention includes: a baking chamber in which phosphors applied onto the second substrate are baked; a coating chamber in which a sealing material which does not contain a binder for making the sealing material into paste form is applied onto a surface of the baked second substrate in a vacuum or in a controlled atmosphere; a coating device which is provided in the coating chamber and applies the sealing material filled inside the coating device onto the surface of the second substrate; a heater which is provided in the coating device and melts the filled sealing material; and a sealing chamber in which the first substrate and the second substrate are laminated to each other via the sealing material, wherein the second substrate is transported from the baking chamber through the coating chamber while the temperature thereof is held at 100° C. or more.

According to the above described apparatus for manufacturing a plasma display panel, it is possible for the heat energy imparted to the second substrate in the baking chamber to be utilized in the coating chamber. As a result, it is possible to achieve improvement in energy savings.

It may be arranged such that the second substrate is transported from the baking chamber through the sealing chamber while being held in a vacuum or in a controlled atmosphere.

In this case, since a sealing material which does not contain a binder is used, it is not necessary to perform the drying step and baking step in the atmosphere for removing the binder in the atmosphere. Because of this, it is possible to introduce the second substrate to the sealing step after the phosphors have been baked while maintaining it in a vacuum or in a controlled atmosphere, and thus preventing any impurity gas from adsorbing to the second substrate. As a result, it is possible to considerably reduce the amount of time required to purify (i.e., dry) the panel interior in the sealing step, or else to eliminate this purification (i.e., drying) altogether. Further, it is also possible to considerably reduce the amount of time required for aging (i.e., pre-conditioning) after the sealing step, or else to eliminate this aging step altogether. Accordingly, it is possible to achieve an improvement in throughput and energy efficiency in manufacturing plasma display panels.

Moreover, another apparatus for manufacturing a plasma display panel having a first substrate and a second substrate according to the present invention includes: a film formation chamber in which a protective film is formed on the first substrate; a baking chamber in which phosphors applied onto the second substrate are baked; a coating chamber in which a sealing material which does not contain a binder for making the sealing material into paste form is applied onto a surface of the baked second substrate in a vacuum or in a controlled atmosphere; a coating device which is provided in the coating chamber and applies the sealing material filled inside the coating device onto the surface of the second substrate; a heater which is provided in the coating device and melts the filled sealing material; and a plurality of sealing chambers which are connected to the film formation chamber and in which the first substrate and the second substrate are laminated to each other via the sealing material, wherein the second substrates are transported from the baking chamber through the coating chamber while the temperature thereof is held at 100° C. or more.

According to the above described apparatus for manufacturing a plasma display panel, since the processing time in the film formation chamber is generally shorter than the processing time in the sealing chamber, it is possible to achieve an improvement in throughput in manufacturing plasma display panels.

It may be arranged such that in the plurality of sealing chambers, when a plurality of plasma display panels having mutually different sizes are being manufactured, first substrates and second substrates which correspond to the sizes of the respective plasma display panels are laminated to each other.

In this case, it is possible to efficiently manufacture panels of different sizes.

Advantageous Effects of the Invention

According to the present invention, by melting a sealing material which does not contain a binder, it is possible to apply the sealing material onto the surface of a second substrate. Moreover, since a sealing material which does not contain a binder is used, it is possible to greatly reduce the quantity of gas released from the sealing material. As a result, it is possible to considerably reduce the time required to purify (i.e., dry) the panel interior in the sealing step, or else to eliminate this purification (i.e., drying) altogether. Further, it is also possible to considerably reduce the amount of time required for aging (i.e., pre-conditioning) after the sealing step, or else to eliminate this aging step altogether.

Moreover, a binder removal step such as that required in the conventional technology is not necessary. Accordingly, it is possible to achieve an improvement in throughput and energy efficiency in manufacturing plasma display panels.

DESCRIPTION OF THE REFERENCE SYMBOLS

Figure 1:
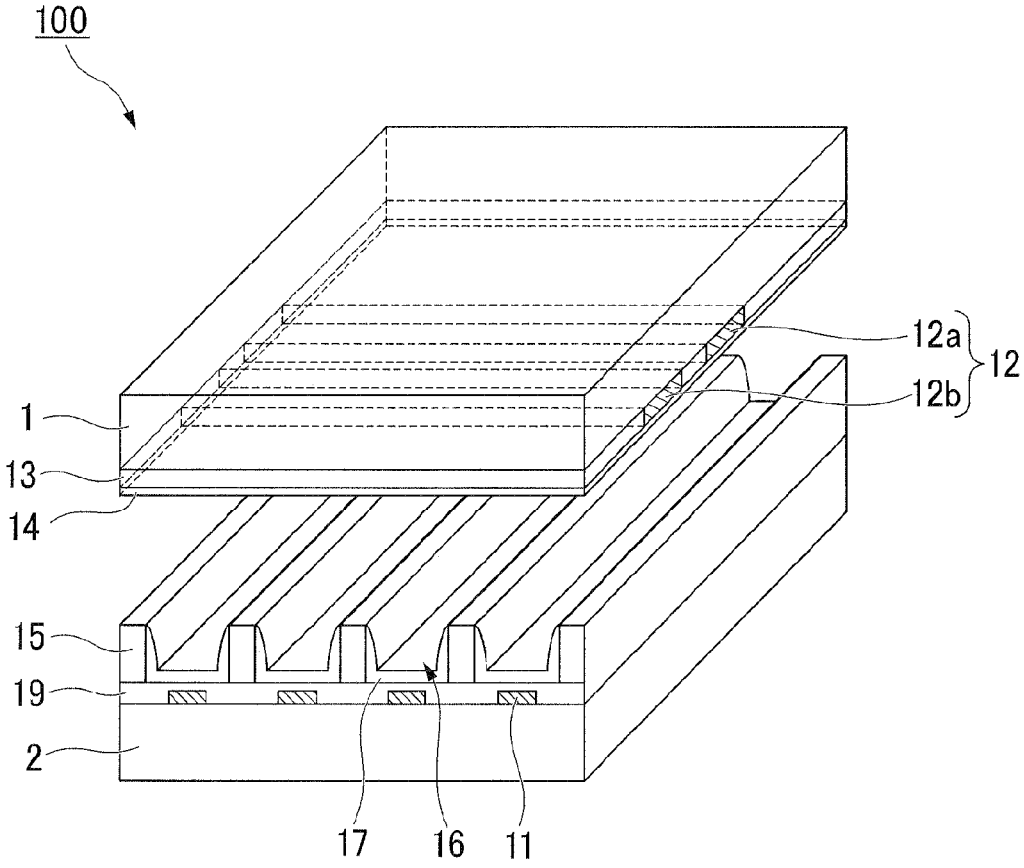
FIG. 1 is an exploded perspective view showing a three-electrode AC type plasma display panel.

1 Front substrate (First substrate)
2 Rear substrate (Second substrate)
17 Phosphor
20 Sealing material
30 Dispenser (Coating device)
34 Heater
64 Film formation chamber
72 Baking chamber
78 Coating chamber
82 Sealing chamber
100 Plasma display panel (Sealed panel)

BEST MODE FOR CARRYING OUT THE INVENTION

Embodiments of the present invention will now be described with reference to the drawings. It should be noted that in the respective drawings referred to in the following description, the scale of the respective components are adequately changed so as be drawn in a recognizable dimension. In addition, in the following description, the 'inner face' of a substrate shall be the surface facing the other substrate.

(Plasma Display Panel)

FIG. 1 is an exploded perspective view of a three-electrode AC type plasma display panel. The plasma display panel (hereinafter referred to as "PDP") 100 is provided with a rear substrate 2 and a front substrate 1 which are arranged so as to face each other and a plurality of electrical discharge chambers 16 which are formed between the substrates 1 and 2.

Display electrodes 12 (i.e., scanning electrodes 12*a* and sustaining electrodes 12*b*) are formed in a stripe pattern at predetermined intervals on the inner face of the front substrate 1. The display electrodes 12 are formed by a transparent conductive material such as ITO and bus electrodes. A dielectric layer 13 is formed so as to cover the display electrodes 12, and a protective film 14 is formed so as to cover the dielectric layer 13. The protective film 14 protects the dielectric layer 13 from positive ions which are generated through the conversion of the discharge gas into plasma, and is formed by an oxide of an alkaline earth metal such as MgO and SrO.

In contrast, address electrodes 11 are formed in a stripe pattern at predetermined intervals on the inner face of the rear substrate 2. The address electrodes 11 are arranged so as to be perpendicular to the display electrodes 12. Intersection points between the address electrodes 11 and the display electrodes 12 form pixels of the PDP 100.

A dielectric layer 19 is formed so as to cover the address electrodes 11. In addition, partition walls (i.e., ribs) 15 are formed in parallel with the address electrodes 11 on the top face of the dielectric layer 19 between mutually adjacent address electrodes 11. Further, phosphors 17 are placed on the top face of the dielectric layer 19 between mutually adjacent partition walls 15 and on the side faces of the partition walls 15. The phosphors 17 emit any one of red, green, or blue fluorescence.

Figure 2A:
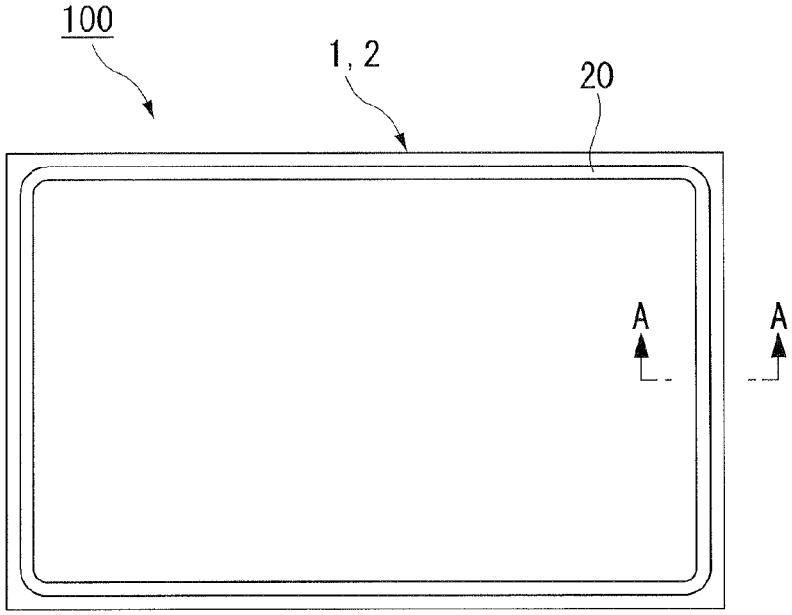
FIG. 2A is a plan view of a PDP.

FIG. 2A is a plan view of a PDP. The above described front substrate 1 and rear substrate 2 are laminated together by means of a sealing material 20 which is placed on peripheral edge portions of the inner faces of the substrates.

Figure 2B:
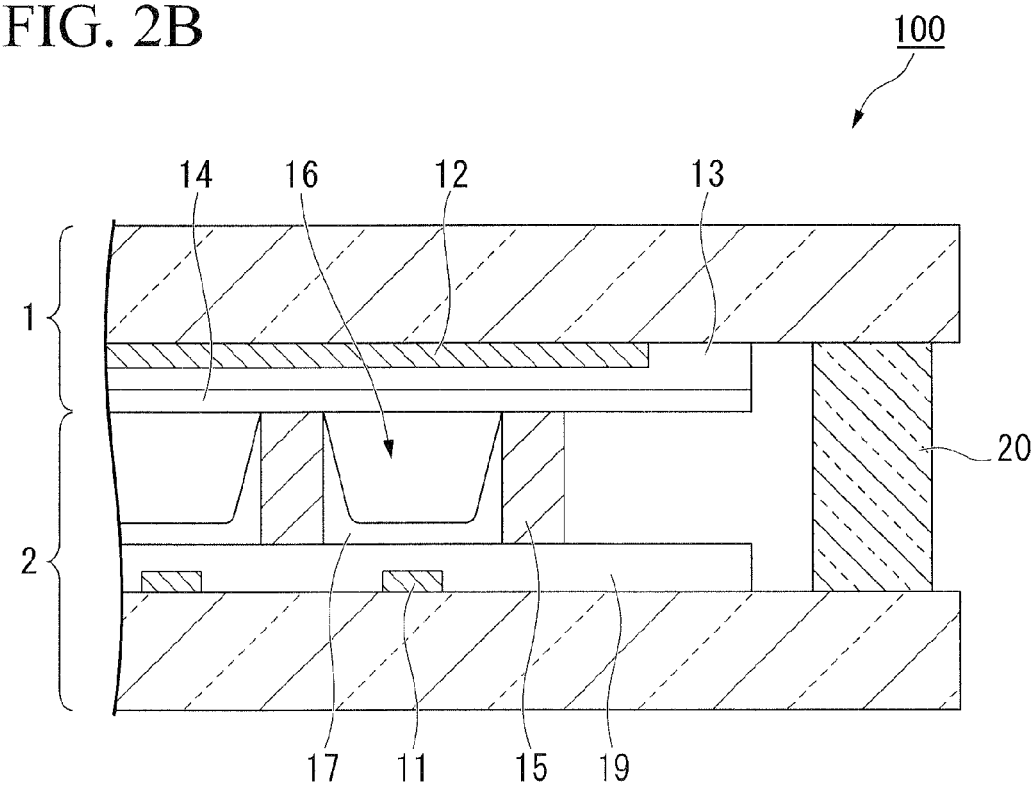
FIG. 2B is a side cross-sectional view taken along a line A-A in FIG. 2A.

FIG. 2B is a side cross-sectional view taken along a line A-A in FIG. 2A. As is shown in FIG. 2B, as a result of the front substrate 1 and the rear substrate 2 being laminated together, electrical discharge chambers 16 are formed between mutually adjacent partition walls 15. Electrical discharge gas such as a mixture of Ne and Xe gases is sealed inside the electrical discharge chambers 16.

By applying direct current voltage between the address electrodes 11 and the scanning electrodes 12*a* of the PDP 100, counter discharge is generated. Further, by applying alternating current voltage between the scanning electrodes 12*a* and the sustaining electrodes 12*b*, surface discharge is generated. As a result, plasma is generated from the electrical discharge gas sealed inside the electrical discharge chambers 16, and vacuum ultraviolet rays are emitted. The phosphors 17 are excited by the ultraviolet light and thus visible light is emitted from the front substrate 1.

(Sealing Material)

As the above described sealing material 20, it is necessary to employ a material which has a coefficient of thermal expansion close to that of glass substrates constituting the front substrate 1 and the rear substrate 2, which exhibits sufficient fluidity at the sealing temperature, and which does not soften at the gas emission/baking temperature. It is also necessary for the material to be able to maintain the air-tightness of the panel interior after sealing and ensure the strength of the panel cohesion but not to release impurity gas. As such a material, a low melting point glass is desirable. Specific examples of such a low melting point glass is a $PbO.B_2O_3$-based non-crystalline glass (i.e., amorphous glass) having a melting point of approximately 400° C.

Moreover, in order to have the coefficient of thermal expansion of the sealing material 20 close to that of the glass substrate, and sufficient fluidity at the sealing temperature, it is desirable to mix a filler into the low melting point glass. An example of such fillers is a ceramic-based powder materials such as alumina or the like.

It is noted that glass which has an even lower melting point (for example, tin-phosphorus oxide-based glass) may be employed in order to alleviate the effects due to the differences between the coefficient of thermal expansion of the sealing material 20 and the coefficient of thermal expansion of the glass substrate. Moreover, crystalline glass having a coefficient of thermal expansion close to that of the glass substrate (for example, having a coefficient of thermal expansion of $85\times10^{-7}$/K) may also be employed even if the melting point is higher than a low melting point glass. Further, it is desirable to improve the wettability between the low melting point glass and the substrate in order to enhance the fluidity thereof at the sealing temperature.

It is noted that, in the conventional technology, a binder is mixed into the sealing material in order to make the sealing material into paste form. The binder is formed from a solvent and a resin component. The solvent is used to make the sealing agent into paste form, and is formed by α-terpineol or the like. The resin component is used to disperse solids in the paste, and is formed by ethyl cellulose, cellulose nitrate, acrylic resin, or the like. It is necessary to completely remove the binder after the sealing material has been applied.

This type of binder is not mixed into the sealing material 20 of the present embodiment.

(PDP Manufacturing Method and Manufacturing Apparatus)

Figure 3:
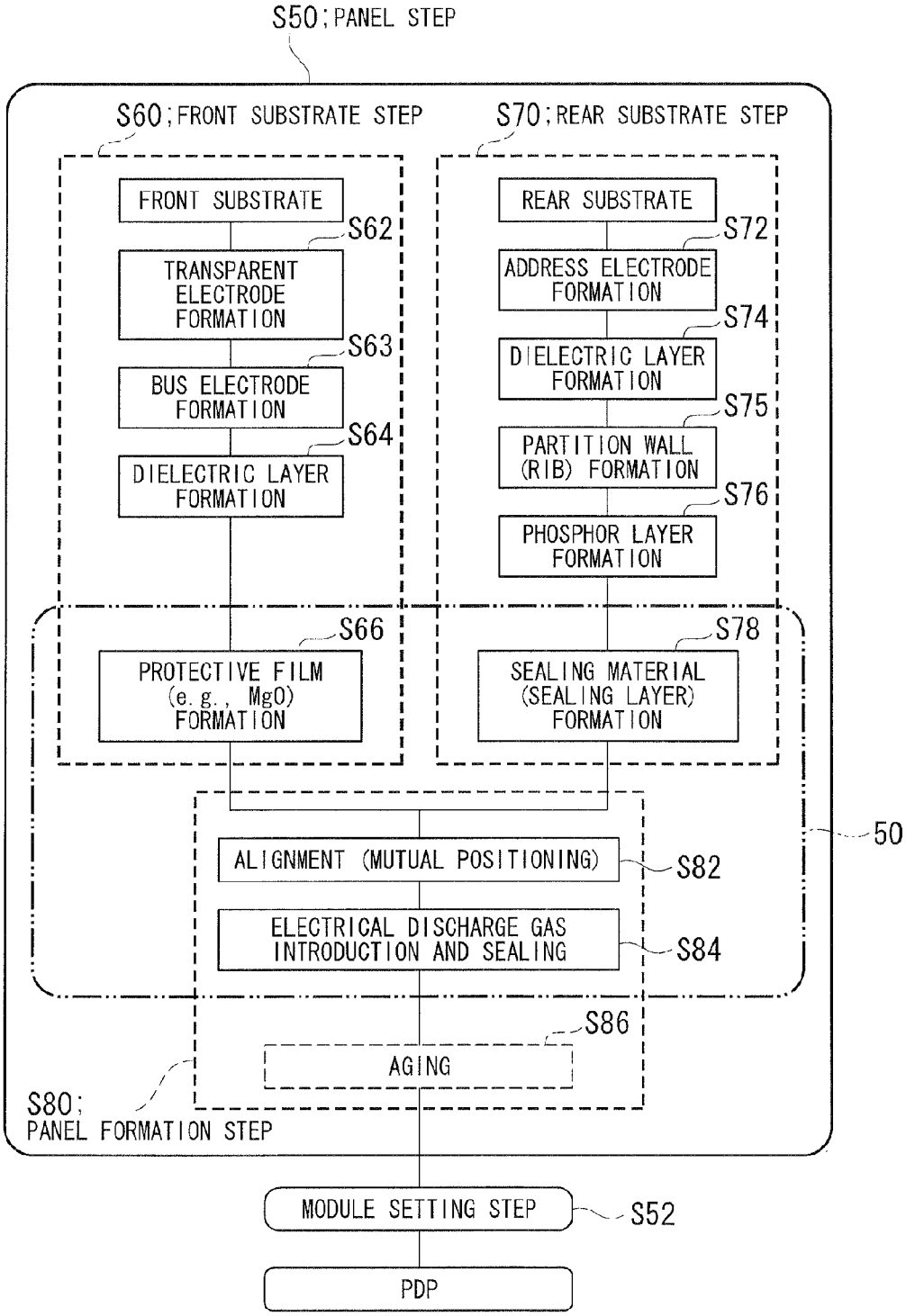
FIG. 3 is a flowchart of a PDP manufacturing method according to a first embodiment of the present invention.

FIG. 3 is a flowchart showing the method for manufacturing a PDP according to a first embodiment of the present invention. The PDP manufacturing process is broadly divided into two steps, namely, a panel step (S50) and a module setting step (S52). The panel step (S50) is divided into a front substrate step (S60), a rear substrate step (S70), and a panel formation step (S80).

In the front substrate step (S60), firstly, the transparent electrodes used for the display electrodes 12 are formed (S62). Specifically, a transparent conductive film such as ITO or $SnO_2$ or the like is formed using a sputtering method or the like, and patterning is then performed so as to form the display electrodes 12. Next, in order to reduce the electrical resistance of the display electrodes 12 which are formed from the transparent conductive film, auxiliary electrodes (i.e., bus electrodes) are formed from a metal material using a sputtering method or the like (S63). Next, a dielectric layer 13 having a thickness of 20 to 40 μm is formed using a printing method or the like in order to protect the respective electrodes and to form a wall charge, and is then baked (S64). Next, in order to protect the dielectric layer 13 and improve the secondary electron discharge efficiency, a protective film 14 having a thickness of 700 to 1200 nm is formed using an electron beam evaporation method (S66).

Figure 4:
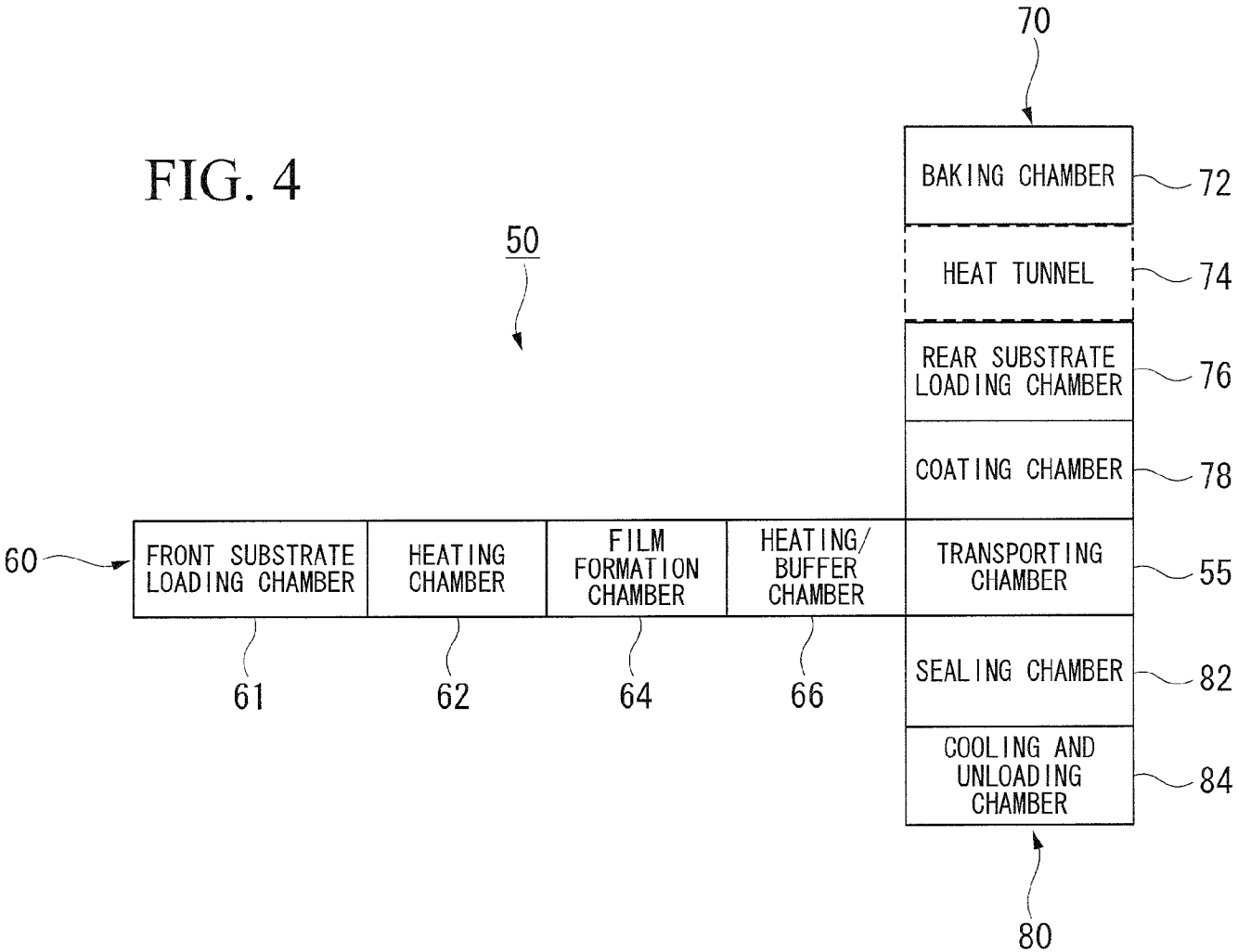
FIG. 4 is a block diagram showing a PDP manufacturing apparatus according to the first embodiment.

FIG. 4 is a block diagram showing the apparatus for manufacturing a PDP according to the first embodiment of the present invention. In the PDP manufacturing apparatus 50, a rear end of a front substrate line 60, a rear end of a rear substrate line 70, and a front end of a panel formation line 80 are each connected to a transporting chamber 55. The PDP manufacturing apparatus 50 continuously performs the tasks within the area 50 which is encompassed by the double-dot chain line in the PDP manufacturing process shown in FIG. 3 in a vacuum or in a controlled atmosphere.

The front substrate line 60 is provided with a loading chamber (i.e., an evacuating chamber) 61 which receives the front substrate 1 having just completed the dielectric layer 13 formation step, a heating chamber 62 which heats the front substrate 1 to approximately 150 to 350° C., a film formation chamber 64 which forms the protective film 14 using an electron beam evaporation method, and a heating/buffer chamber 66 which heats the rear substrate 2 to the same temperature as that to which the front substrate 1 is heated (approximately 380° C.).

In contrast, in the rear substrate formation step (S70) shown in FIG. 3, address electrodes 11 which are formed from Ag, Cr/Cu/Cr, or Al are formed (S72). Next, a dielectric layer 19 is formed in order to protect the address electrodes 11 (S74). Next, partition walls 15 are formed using a sand-blasting method or the like in order to increase the electrical discharge space and the light emission surface area of the phosphors 17 (S75). The sand-blasting method involves coating a glass paste being the material for the partition walls 15 onto the substrate, drying the glass paste and then arranging thereon a mask material having a pattern, and then blasting the substrate with a polishing agent such as alumina, glass beads or the like so as to form partition walls 15 having a predetermined shape. Next, the phosphors 17 are applied using a screen printing method or the like, and are then dried. Thereafter, the dried phosphors 17 are baked at approximately 500° C. (S76). Next, the sealing material 20 is applied onto the surface of the rear substrate 2 while the rear substrate 2 is being heated (S78).

The rear substrate line 70 is provided with a baking chamber 72 which receives the rear substrate 2 on which the phosphors 17 have been applied and which bakes the rear substrate 2, and a coating chamber 78 which applies the sealing material 20 onto the surface of the rear substrates 2 as shown in FIG. 4. A heat tunnel 74 and a rear substrate loading chamber 76 are provided between the baking chamber 72 and the coating chamber 78. The tunnel 74 and rear substrate loading chamber 76 transport the rear substrate 2 which have been baked in the baking chamber 72 to the coating chamber 78 while maintaining the temperature thereof at 100° C. or more so that the rear substrate 2 can be coated in the coating chamber 78 with the sealing material 20. Accordingly, it is possible for the heat energy imparted to the rear substrates 2 in the baking chamber 72 to be utilized in the coating chamber 78. As a result, it is possible to achieve improvement in energy savings.

The heat tunnel 74 is a substrate transporting chamber which is provided with a heat conservation mechanism for maintaining the temperature of the rear substrate 2 after baking. It is noted that, instead of the heat tunnel 74, it may be possible to transport the rear substrate using a stocker type container. Moreover, the heat tunnel 74 may be provided with an exhaust system in order to conduct atmosphere separation. In the rear substrate loading chamber 76, evacuating is performed while maintaining the temperature of the rear substrate 2 after baking held at 100° C. or more. It is noted that the rear substrate 2 may be heated in the rear substrate loading chamber 76.

(Sealing Material Coating Chamber, Coating Apparatus, and Coating Method)

Figure 5:
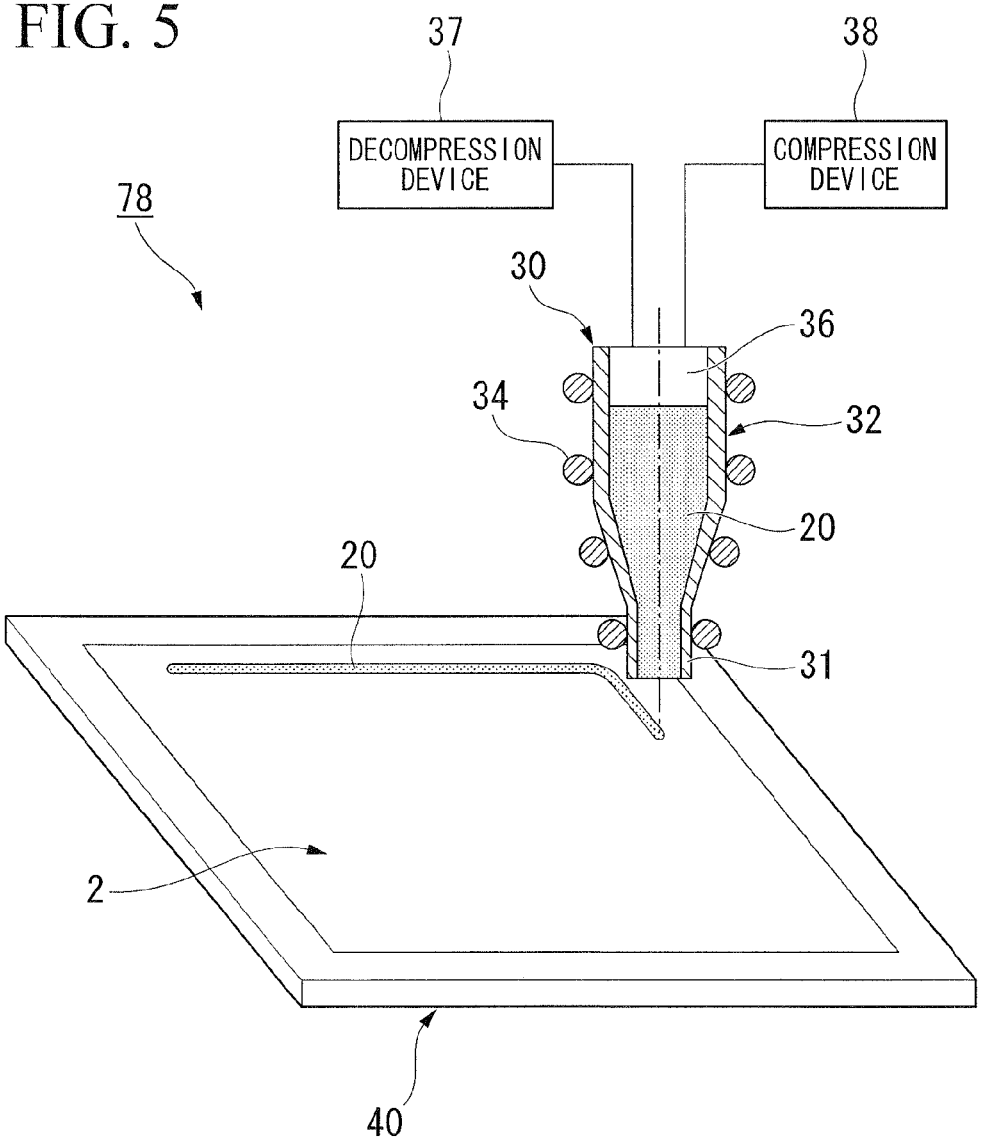
FIG. 5 is a perspective view showing the internal structure of a sealing material coating chamber.

FIG. 5 is a perspective view showing the internal structure of a sealing material coating chamber. A hot plate 40 on which is placed a rear substrate 2 to be coated with the sealing material 20 is provided in a bottom portion of the coating chamber 78.

The hot plate 40 is able to heat the rear substrate 2 to a temperature of approximately 100 to 450° C. It is noted that, instead of the hot plate 40, a heater may be installed to perform radiation heating to the rear substrate 2. A dispenser (i.e., a coating device) 30 which discharges the sealing material 20 is provided above the hot plate 40. The hot plate 40 may be mounted on an XY stage (not shown) such that the hot plate 40 and dispenser 30 are able to move relatively to each other within a horizontal plane. It may also be arranged such that the hot plate 40 is fixed in position and the dispenser 30 is installed on an XY movable mechanism (i.e., a plane scanning mechanism). In addition, the coating chamber 78 is provided with an evacuation system (not shown) which consists of a turbo-molecular pump and a cold trap for absorbing and discharging moisture.

In the dispenser 30, a nozzle 31 is fitted onto the distal end of a syringe 32 having cylindrical shape. Sealing material 20 filled inside the syringe 32 is discharged from the distal end of the nozzle 31. A heater 34 is provided so as to surround the outer circumference of the syringe 32 and nozzle 31. The sealing material 20 filled inside the dispenser 30 is heated by the heater 34 to greater than or equal to its melting point and is accordingly melted.

A decompression device 37 such as a vacuum pump and a compression device 38 such as a compressor are connected to a top end of the syringe 32. The decompression device 37 causes gas contained inside melted sealing material 20 to be pumped out therefrom. The compression device 38 causes melted sealing material 20 to be quantitatively discharged from the nozzle 31.

In applying the sealing material 20 onto the surface of the rear substrate 2 inside the above described coating chamber 78, firstly, the interior of the dispenser 30 is filled with the low melting point glass and filler powder which form the sealing material 20. Next, electric current is conducted to the heater 34 so that the powder of the sealing material 20 is heated to a higher temperature than or equal to its melting point (i.e., approximately 300 to 480° C.). During the heating, the decompression device 37 is driven so that an interior 36 of the syringe 32 is decompressed to approximately 0.1 Pa. As a result, gas (such as $H_2$, $H_2O$, $N_2$, CO, $CO_2$, and the like) contained within the melted sealing material 20 is removed therefrom (i.e., vacuum deaeration processing).

It is noted that low melting point glass and filler may be molded into a cylindrical shape in advance, and then set the molded material in the syringe. In this case, vacuum deaeration processing is performed during the molding or when the molded material is being melted after it has been set in the syringe. Further, low melting point glass and filler, or low melting point glass alone may be melted, deaerated and stirred in advance, and then the resulting material may be supplied to the syringe using a transporting device such as a pipe.

Next, the interior of the coating chamber 78 is held in a vacuum or in a controlled atmosphere. Next, a rear substrate 2 is placed on top of the hot plate 40. Next, the hot plate 40 is moved using the XY stage, and the coating start position on the rear substrate 2 where application of the sealing material 20 begins is placed below the dispenser 30. Next, the compression device 38 is driven so that the interior of the syringe 32 is compressed to a predetermined pressure. As a result, the melted sealing material 20 is discharged quantitatively from the nozzle 31. In this state, by moving the hot plate 40 using the XY stage, the sealing material 20 can be applied continuously onto peripheral edge portions of the rear substrate 2.

Returning to FIG. 3, a panel formation step in which the above described front substrate 1 and rear substrate 2 are laminated together is performed (S80). In the panel formation step, an alignment step (S82) to align the two substrates, and an electrical discharge gas introduction and sealing step (S84) are performed. It is noted that, if necessary, an aging step (S86) is performed for a short period of time.

As is shown in FIG. 4, after the front substrate 1 on which the protective film 14 is formed is heated to approximately 380° C. in the heating/buffer chamber, the front substrate 1 is transported to a sealing chamber 82 via the transporting chamber 55. The transported front substrate 1 is held by a hook mechanism provided in a top portion of the sealing chamber 82. While the front substrate 1 is being held, its temperature is maintained at approximately 380° C. by a heater placed in the top portion of the sealing chamber 82.

In contrast, the rear substrate 2 on which the sealing material 20 is applied is transported from the coating chamber 78 to the sealing chamber 82 via the transporting chamber 55. The transported rear substrate 2 is placed on the hot plate provided in a bottom portion of the sealing chamber 82 and is held at approximately 380° C. Next, alignment marks on the front substrate 1 and rear substrate 2 are read by a CCD camera installed on the atmosphere side of a vacuum tank provided in the sealing chamber, and the two substrates are positioned relative to each other. Next, electrical discharge gas is introduced, pressure is applied to the two substrates, the sealing material is heated to approximately 430 to 450° C., and then sealing is achieved. The panel obtained by the sealing is then transported to a cooling/unloading chamber where it is cooled to approximately 150° C. and is then unloaded.

It is noted that, in the present embodiment, since a sealing material which does not contain a binder is used, it is not necessary to perform drying step and baking step in the open atmosphere in order to remove the binder. Because of this, the rear substrate 2 whose phosphors have been baked in the baking chamber 72 is introduced to the sealing chamber 82 via the heat tunnel 74, the rear substrate loading chamber 76, the coating chamber 78, and the transporting chamber 55 while being maintained in a vacuum or in a controlled atmosphere. Namely, it is possible to introduce the rear substrate 2 to the sealing chamber 82 while preventing any impurity gas from adsorbing thereto. Because of this, it is possible to considerably reduce the amount of time required to purify (i.e., dry) the panel interior in the sealing step, or else to eliminate this purification (i.e., drying) altogether. Further, it is also possible to considerably reduce the amount of time required for aging (i.e., pre-conditioning) after the sealing step, or else to eliminate this aging step altogether. Accordingly, it is possible to achieve an improvement in throughput and energy efficiency.

It should be noted that in the conventional technology, since a binder which is made of a solvent and a resin component is mixed into the sealing material, there is a possibility that impurity gases from the sealing material is intruded into the panel interior. In such cases, the purity of the electrical discharge gas sealed inside the panel becomes deteriorated, and that causes a rise of the discharge voltage. Moreover, if the impurity gas discharged from the sealing material is absorbed by the coating film on the surface of the substrate, the secondary electron discharge coefficient of the surface of the substrate also deteriorates resulting in causing a rise of the discharge voltage. The power consumption of the PDP also increases in conjunction with the rise of the discharge voltage. For this reason, conventionally, prior to the sealing step a drying step is performed in order to remove solvent from the binder, and a baking step is performed in order to remove the resin component from the binder. However, it is still difficult to remove the resin component sufficiently even if this baking step is performed.

The inventors of the present invention performed experiments to measure the quantity of released gas from the sealing material according to the conventional technology (i.e., after temporary baking) and released gas from the sealing material according to the present invention.

Figure 6:
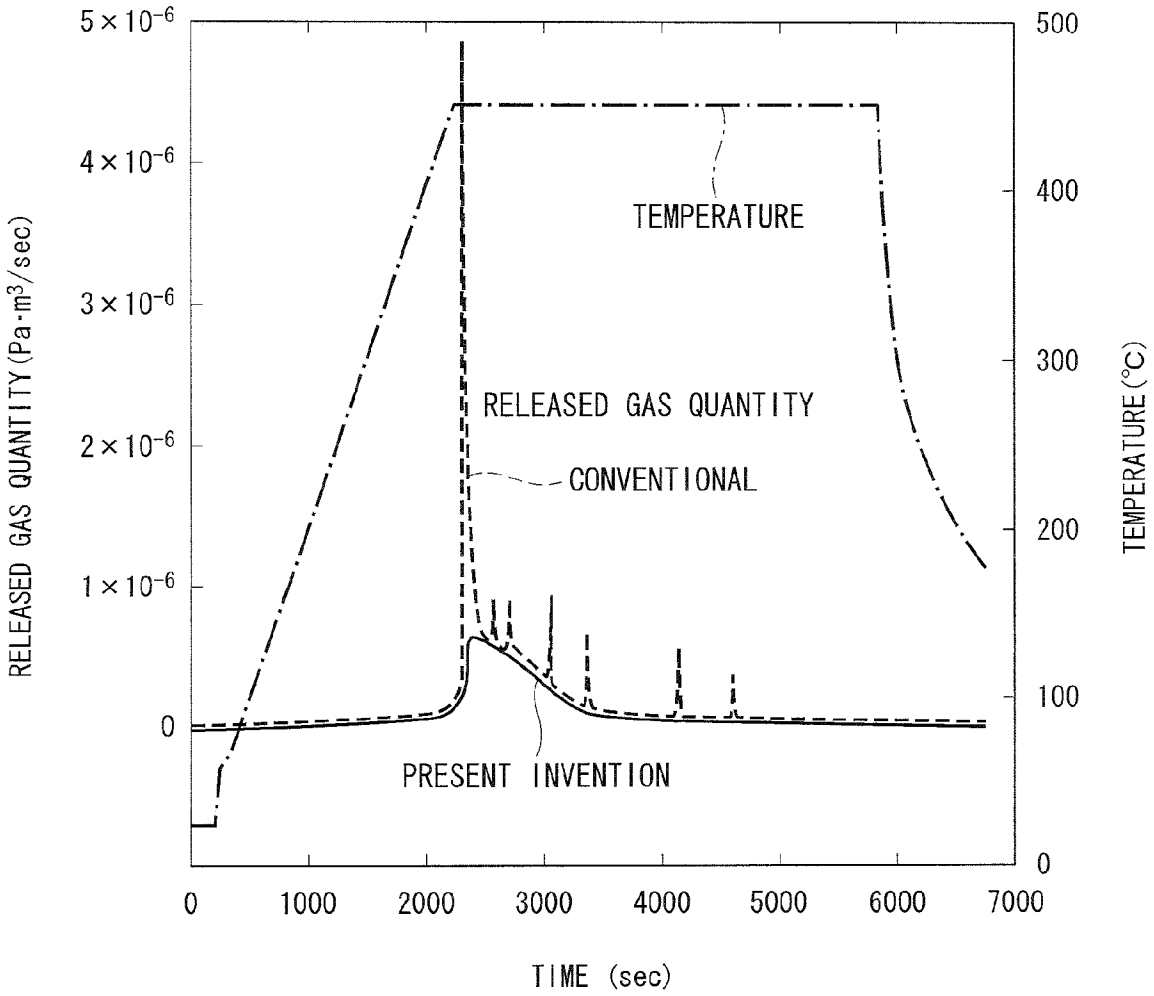
FIG. 6 is a graph showing measurement results when a quantity of released gas from a sealing material is measured using a temperature-programmed desorption method.

FIG. 6 is a graph showing measurement results when the quantity of released gas from the sealing material was measured using thermal desorption spectroscopy (TDS). In TDS, the temperature of the sealing material is raised to approximately 450° C. over approximately 2200 seconds, and is then held in this state. In FIG. 6, the measurement results of the quantity of released gas from a conventional sealing material (i.e., after temporary baking) are shown by a broken line, while the measurement results of the quantity of released gas from the sealing material according to the present invention are shown by a solid line. In the conventional sealing material, in addition to the resin component being detected as a discharge gas, water ($H_2O$), carbon monoxide (CO), and carbon dioxide ($CO_2$) were detected in large quantities because baking was performed in air. In contrast, in the sealing material according to the present invention, the quantity of released gas was reduced and no resin component was detected.

Impurity gas which is absorbed by the coating film on the surface of the substrate is released from the surface of the substrate if the substrate interior is purified by vacuum baking and if voltage is applied between the substrates for a predetermined time (i.e., if aging processing is performed). Through the process above, the discharge voltage becomes stable. Therefore, in the conventional technology, purification (i.e., drying) is performed for several hours in the sealing step. It has also been necessary to perform aging processing for between several hours and several tens of hours on panels which have completed the sealing step.

The inventors of the present invention performed aging experiments on a PDP manufactured according to the conventional method and on a PDP manufactured using the method according to the present embodiment. MgO having a film thickness of 800 nm was used for the protective film 14 of the PDP in the experiments, and Ne-4% Xe was introduced at a pressure of 66.5 kPa as the electrical discharge gas.

It is noted that in the conventional technology, the respective manufacturing processes to manufacture a PDP are performed using a variety of different apparatuses. In view of the above, a PDP was manufactured after the front substrate 1 which has completed the film formation of the protective film 14 was exposed to air (having a humidity of 50%) for one hour. Moreover, during the sealing together of the front substrate 1 and the rear substrate 2, purification (i.e., drying) was performed for 90 minutes at 350° C.

In contrast, in the PDP manufacturing method and manufacturing apparatus of the present embodiment, the process from the formation of the protective film to the sealing step was performed either in a vacuum or in a controlled atmosphere. Specifically, a PDP was manufactured without the front substrate 1 which had completed the film formation of the protective film 14 being exposed to air.

Figure 7:
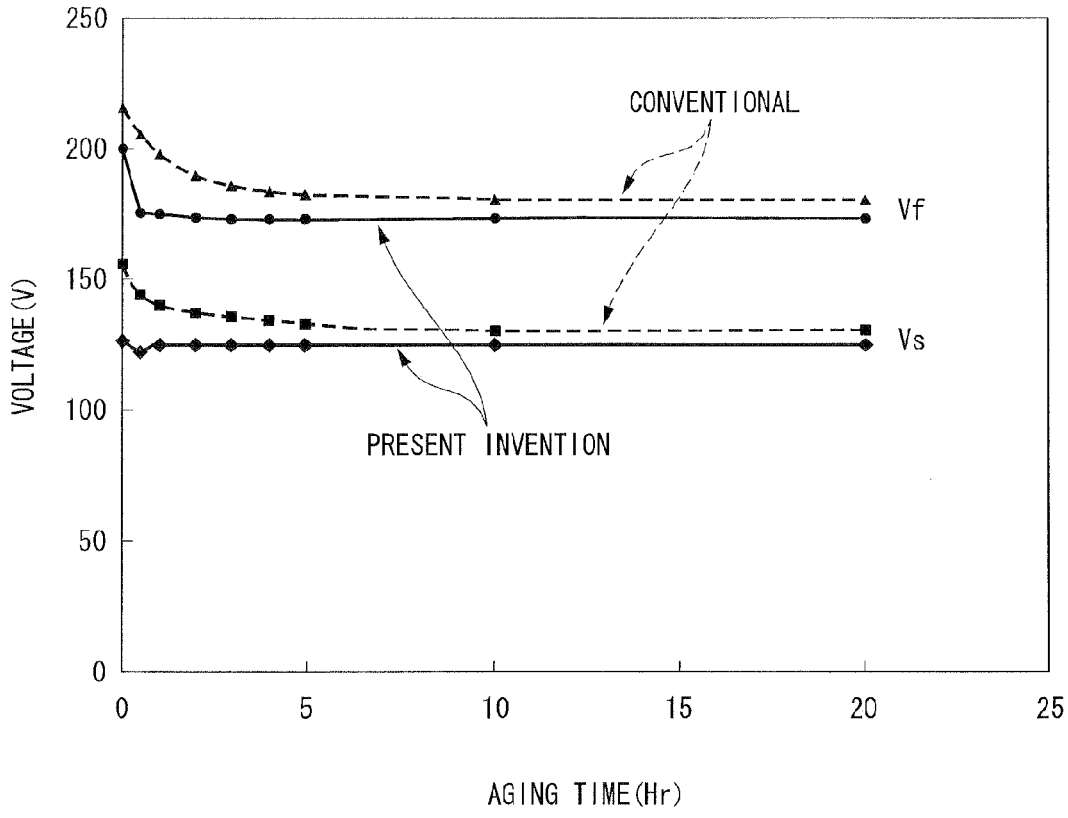
FIG. 7 is a graph showing results of an aging test.

FIG. 7 is a graph showing the results of the aging experiments. It is noted that Vf is the discharge starting voltage, and Vs is the discharge sustaining voltage. In the case of the PDP manufactured using the conventional method including the exposure of the substrate to air, both the discharge starting voltage Vf and the discharge sustaining voltage Vs are higher, and approximately 3 hours are necessary until the voltage stabilizes. In contrast, in the case of PDP manufactured using the method of the present embodiment, both the discharge starting voltage Vf and the discharge sustaining voltage Vs are lower, and the discharge starting voltage Vf stabilizes within approximately one minute while the discharge sustaining voltage Vs is stable from the beginning. From these results, it was confirmed that, by employing the PDP manufacturing method and manufacturing apparatus of the present embodiment, it is possible to shorten the aging time. Moreover, it was confirmed that the discharge voltage is lowered. Namely, by employing the PDP manufacturing method and manufacturing apparatus of the present embodiment, it is possible to provide a PDP having a low level of power consumption.

As is described in detail above, the PDP manufacturing method of the present embodiment is provided with a step of melting a sealing material 20 which does not contain any binder for making the sealing material into paste form inside a dispenser, a coating step of applying the melted sealing material 20 onto the surface of a rear substrate 2 using the dispenser, and a sealing step of laminating a front substrate 1 and rear substrate 2 via the sealing material 20 applied onto the surface of the rear substrate 2.

According to the PDP manufacturing method, even if a sealing material 20 which does not contain any binder is used, by melting the sealing material 20 inside a dispenser, it can be applied onto the surface of a rear substrate 2. Moreover, since a sealing material 20 which does not contain any binder is used, it becomes possible to greatly reduce the quantity of released gas from the sealing material 20. As a result, it becomes possible to greatly reduced the purification (i.e., drying) time required to purify the panel interior in the sealing step, or else to eliminate this purification (i.e., drying) altogether. Further, it becomes possible to greatly reduce the amount of time required for aging (i.e., pre-conditioning) after the sealing, or else to eliminate this aging step altogether. Moreover, the binder removal step of the conventional technology can be eliminated. Accordingly, it is possible to achieve an improvement in throughput and energy efficiency in manufacturing PDP.

Moreover, the PDP manufacturing method of the present embodiment is provided with a step of decompressing the interior of the dispenser prior to the coating step so that any gas contained within the sealing material 20 is released.

In this case, since a sealing material 20 from which internal gas has been released is applied, it is possible to even further reduce the quantity of released gas released from the coated sealing material 20. As a result, it becomes possible to greatly reduce the purification (i.e., drying) time required to purify the panel interior in the sealing step, or else to eliminate this purification (i.e., drying) altogether. Further, it becomes possible to greatly reduce the amount of time required for aging (i.e., pre-conditioning) after the sealing, or else to eliminate this aging step altogether. Accordingly, it is possible to achieve an improvement in throughput and energy efficiency in manufacturing PDP.

Second Embodiment

Figure 8:
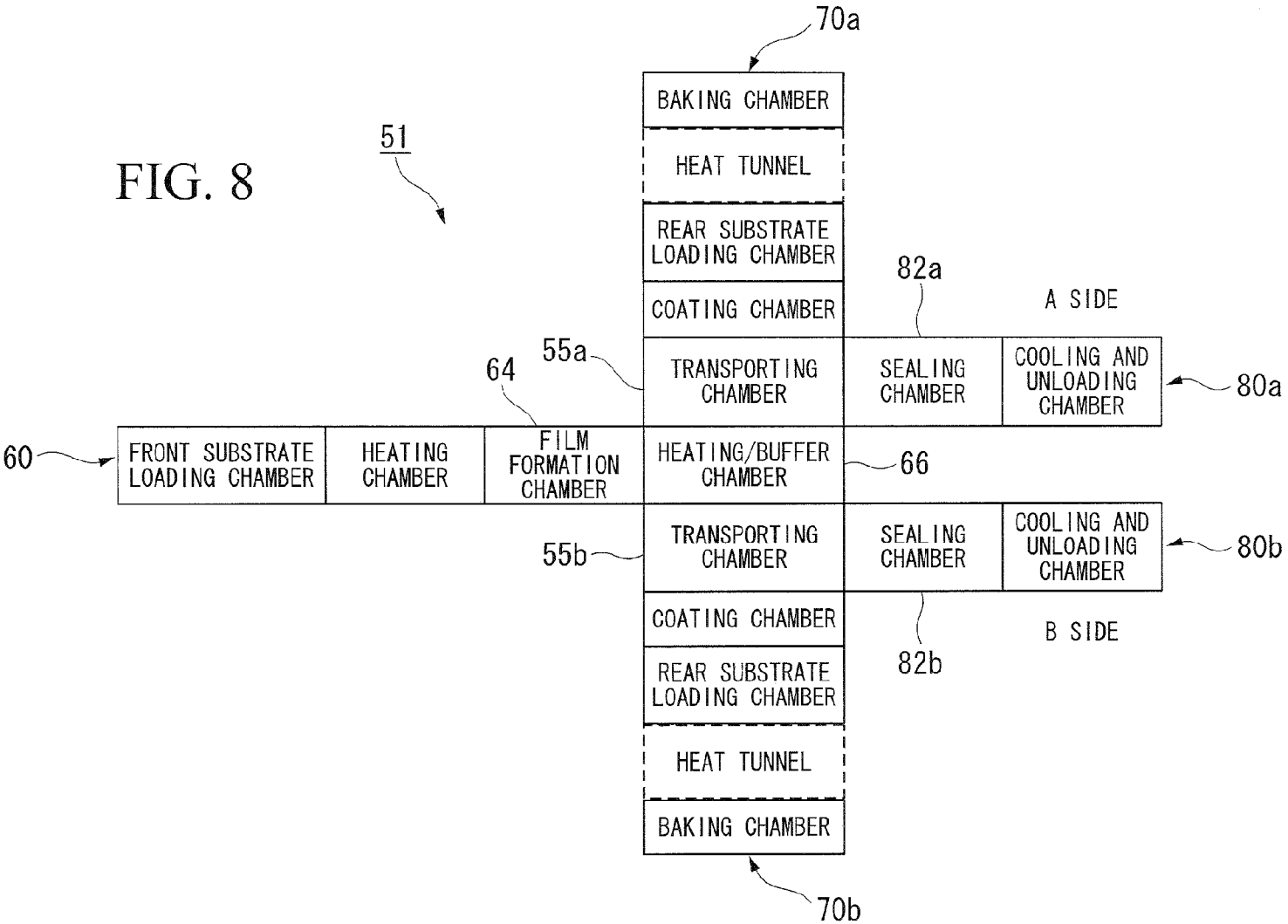
FIG. 8 is a block diagram showing a PDP manufacturing apparatus according to a second embodiment.

FIG. 8 is a block diagram showing a PDP manufacturing apparatus according to a second embodiment. In the PDP manufacturing apparatus according to the first embodiment, one sealing chamber is connected to one film formation chamber. In contrast, in the PDP manufacturing apparatus according to the second embodiment, a plurality of sealing chambers 82*a* and 82*b* are connected to one film formation chamber 64. It is noted that any detailed description of portions which are the same as those in the first embodiment is omitted.

In a PDP manufacturing apparatus 51 according to the present embodiment, a transporting chamber 55*a* is connected to an A side of a heating/buffer chamber 66 on the front substrate line 60, while a transporting chamber 55*b* is connected to a B side of the heating/buffet chamber 66. A rear substrate line 70*a* and a panel formation line 80*a* are connected to the A side transporting chamber 55*a*. A rear substrate line 70*b* and a panel formation line 80*b* are connected to the B side transporting chamber 55*b*. For this reason, the sealing chambers 82*a* and 82*b* of the rear substrate lines 70*a* and 70*b* are connected to the film formation chamber 64 of the front substrate line 60. In the present embodiment, the rear substrate lines 70*a* and 70*b* extend perpendicularly to the front substrate line 60, and the panel formation lines 80*a* and 80*b* extend parallel with the front substrate line 60.

In the PDP manufacturing apparatus 51 of the present embodiment as well, in the same way as in the first embodiment, it becomes possible to greatly reduce the quantity of released gas from the sealing material 20. As a result of this, it becomes possible to greatly reduce the purification (i.e., drying) time required to purify the panel interior in the sealing step, or else to eliminate this purification (i.e., drying) altogether. Further, it becomes possible to greatly reduce the amount of time required for aging (i.e., pre-conditioning) after the sealing, or else to eliminate this aging step altogether. Accordingly, it is possible to achieve an improvement in throughput and energy efficiency in manufacturing PDP.

Generally, the tact time required for the film formation step in the film formation chamber 64 is shorter compared to the tact time required for the panel formation step in the sealing chambers 82*a* and 82*b*. Therefore, in the present embodiment, a structure is employed in which a plurality of sealing chambers 82*a* and 82*b* are connected to the film formation chamber 64. By employing this structure, it becomes possible to improve the operating efficiency of the film formation chamber. As a result, compared with the first embodiment, it is possible to improve throughput (for example by a factor of approximately 2) in manufacturing PDP.

It is noted that the plurality of sealing chambers 82*a* and 82*b* may be formed such that the sizes of front substrate 1 and rear substrate 2 laminated together are different between the plurality of sealing chambers. Namely, it is possible to employ a structure in which, in the plurality of sealing chambers 82*a* and 82*b*, when manufacturing a plurality of PDPs having mutually different sizes, a front substrate 1 and a rear substrate 2 which correspond to the size of each of the PDPs are laminated together. For example, a structure can be employed in which the sealing of a panel having a diagonal length of 42 inches is performed in the A side sealing chamber 82*a*, while the sealing of a panel having a diagonal length of 50 inches is performed in the B side sealing chamber 82*b*. In this case, the film formation chamber 64 is formed so as to conduct film formation for front substrates of different sizes. As a result, it is possible to efficiently manufacture panels of different sizes. Moreover, when manufacturing panels having mutually different sizes, a portion of the manufacturing apparatus (i.e., the front substrate line including the film formation chamber) can be shared. As a result, manufacturing costs can be reduced.

Variant Example

Figure 9:
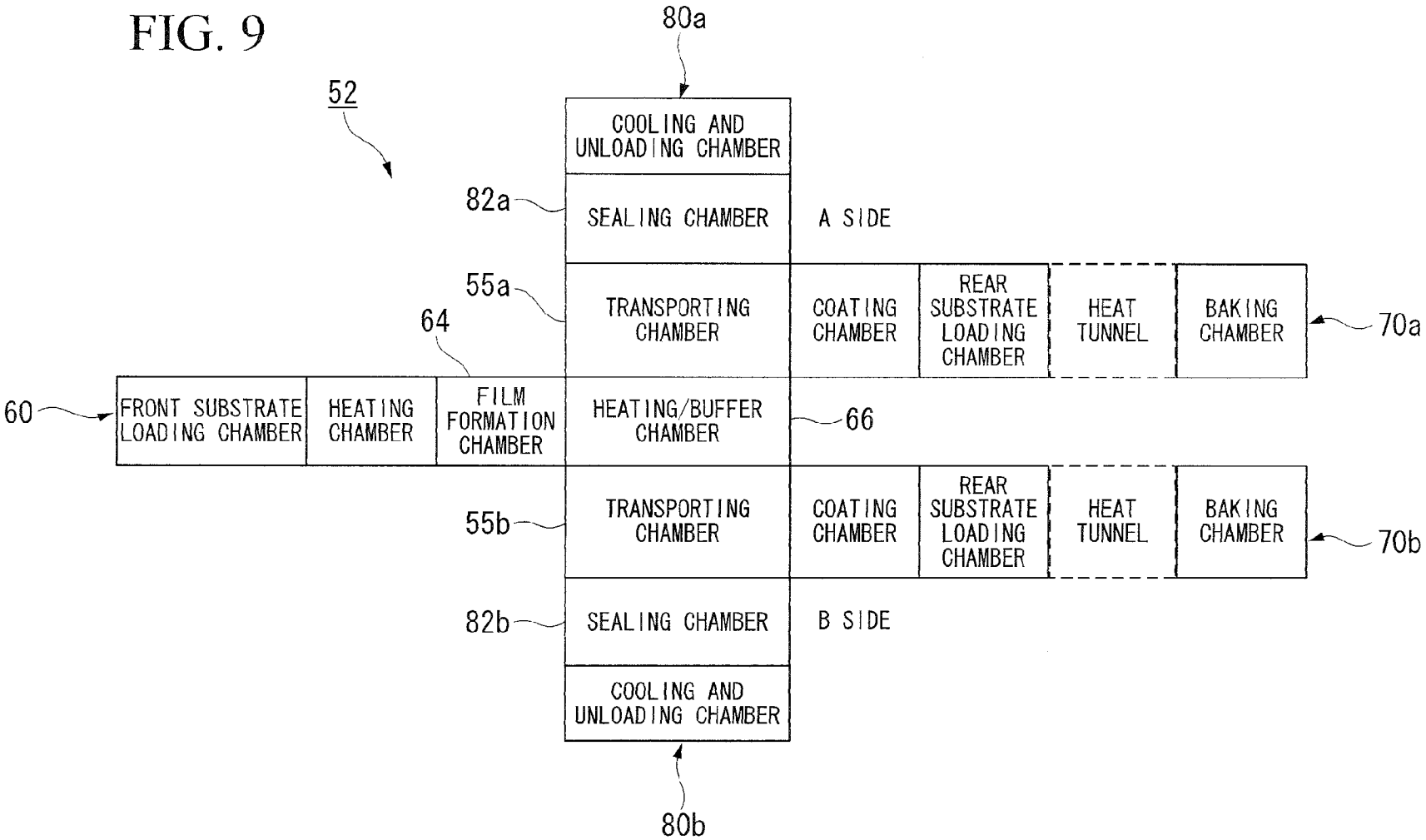
FIG. 9 is a block diagram showing a PDP manufacturing apparatus according to a variant example of the second embodiment.

FIG. 9 is a block diagram showing a PDP manufacturing apparatus according to a variant example of the second embodiment. In the above described PDP manufacturing apparatus of the second embodiment, the rear substrate lines 70*a* and 70*b* extend perpendicularly to the front substrate line 60, and the panel formation lines 80*a* and 80*b* extend parallel with the front substrate line 60. However, in a PDP manufacturing apparatus 52 according to the variant example shown in FIG. 9, the rear substrate lines 70*a* and 70*b* extend parallel with the front substrate line 60, while the panel formation lines 80*a* and 80*b* extend perpendicularly to the front substrate line 60.

In this case as well, compared with the first embodiment, it is possible to improve throughput in manufacturing PDP. Moreover, it is also possible to efficiently manufacture substrates of different sizes on the two sides.

It should be noted that the range of technology of the present invention is not limited to the above described embodiments, and various modifications can be made to the above described embodiments insofar as they do not depart from the spirit or scope of the present invention. Namely, the specific materials and structure and the like described in the respective embodiments are simply an example thereof, and appropriate modifications may be made thereto.

For example, in the above described embodiments, a sealing material obtained by mixing a filler in low melting point glass is employed, however, it is also possible to employ a sealing material which contains no filler and is formed solely by low melting point glass.

Moreover, in the above described embodiments, the present invention is applied to a plasma display panel, however, may be applied to a field emission display panel. In the field emission display panel, electrons are emitted from electron emission source (i.e., emitter) provided for every pixel into vacuum, and collided against phosphors, thereby attaining light emission. Examples of field emission display panels include a FED (Field Emission Displays) equipped with projection-shaped electron emission pixels, and a SED (Surface-Conduction Electron-Emitter Displays) equipped with surface conduction-type electron emission pixels. Even in a case where the present invention is applied to these field emission display panels, it is still possible to reduce the aging time, and suppress any rise in the discharge voltage.

INDUSTRIAL APPLICABILITY

It is possible to provide a sealed panel manufacturing method and manufacturing apparatus, and also a plasma display panel manufacturing method and manufacturing apparatus which make it possible to achieve an improvement in throughput and energy efficiency.

What is claimed is:

1. A method for manufacturing a sealed panel having a first substrate and a second substrate, comprising:

a melting step of melting a sealing material which does not contain a binder for making the sealing material into paste form and contains a low melting point glass and a filler;

an emitting step of emitting gas contained within the melted sealing material;

a baking step of baking phosphors applied onto the second substrate;

a coating step of applying the melted sealing material onto a surface of the baked second substrate; and a sealing step of laminating the first substrate and the second substrate via the sealing material applied onto the surface of the second substrate, wherein the temperature of the second substrate is held at 100° C. or more from the baking step through the coating step.

2. An apparatus for manufacturing a sealed panel having a first substrate and a second substrate, comprising:

a baking chamber in which phosphors applied onto the second substrate are baked;

a coating chamber in which a sealing material which does not contain a binder for making the sealing material into paste form and contains a low melting point glass and a filler is applied onto a surface of the baked second substrate in a vacuum or in a controlled atmosphere;

a coating device which is provided in the coating chamber and applies the sealing material filled inside the coating device onto the surface of the second substrate;

a heater which is provided in the coating device and melts the filled sealing material;

a decompression device which is connected to the coating device and causes gas contained within the melted sealing material to be pumped out therefrom; and a sealing chamber in which the first substrate and the second substrate are laminated to each other via the sealing material, wherein the second substrate is transported from the baking chamber through the coating chamber while the temperature thereof is held at 100° C. or more.

3. The method for manufacturing a sealed panel according to claim 1, wherein the second substrate is held in a vacuum or a controlled atmosphere from the baking step through the sealing step.

4. The apparatus for manufacturing a sealed panel according to claim 2, wherein the second substrate is transported from the baking chamber through the sealing chamber while being held in a vacuum or in a controlled atmosphere.

* * * * *